US007386451B2

(12) United States Patent
Chu et al.

(10) Patent No.: US 7,386,451 B2
(45) Date of Patent: Jun. 10, 2008

(54) OPTIMIZATION OF AN OBJECTIVE MEASURE FOR ESTIMATING MEAN OPINION SCORE OF SYNTHESIZED SPEECH

(75) Inventors: Min Chu, Beijing (CN); Hu Peng, San Francisco, CA (US); Yong Zhao, Beijing (CN)

(73) Assignee: Microsoft Corporation, Redmond, WA (US)

( * ) Notice: Subject to any disclaimer, the term of this patent is extended or adjusted under 35 U.S.C. 154(b) by 853 days.

(21) Appl. No.: 10/660,388

(22) Filed: Sep. 11, 2003

(65) Prior Publication Data

US 2005/0060155 A1 Mar. 17, 2005

(51) Int. Cl.
*G10L 13/08* (2006.01)
*G10L 13/00* (2006.01)

(52) U.S. Cl. ..... 704/260; 704/258

(58) Field of Classification Search ..... None
See application file for complete search history.

(56) References Cited

U.S. PATENT DOCUMENTS

| | | | | |
|---|---|---|---|---|
| 5,634,086 | A | 5/1997 | Rtischev et al. | 704/270 |
| 5,903,655 | A | 5/1999 | Salmi et al. | 381/321 |
| 6,260,016 | B1 | 7/2001 | Holm et al. | 704/260 |
| 6,370,120 | B1 | 4/2002 | Hardy | 370/252 |
| 6,446,038 | B1 | 9/2002 | Bayya et al. | 704/232 |
| 6,594,307 | B1 | 7/2003 | Beerends | 375/224 |
| 6,609,092 | B1 | 8/2003 | Ghitza et al. | 704/226 |
| 6,810,378 | B2 | 10/2004 | Kochanski et al. | 704/258 |
| 6,965,597 | B1 * | 11/2005 | Conway | 370/389 |
| 7,024,362 | B2 | 4/2006 | Chu et al. | 704/260 |
| 7,050,924 | B2 * | 5/2006 | Rix et al. | 702/124 |
| 7,305,341 | B2 * | 12/2007 | Kim | 704/259 |
| 7,328,157 | B1 * | 2/2008 | Chu et al. | 704/260 |
| 2002/0173961 | A1 | 11/2002 | Guerra | 704/258 |

OTHER PUBLICATIONS

Peng, H. Zhao, Y. Chu, M. "Perceptually optimizing with cost function for unit selection in TTS system with one single run of MOS evaluation." 7th International Conference on Spoken Language Processing, Sep. 16-20, 2002.*

Hagen, R. Paksoy et al, "Voicing-Specific LPC Quantization for Variable-Rate Speech Coding", IEEE transactions on speech and audio processing, vol. 1, No. 5, Sep. 1999.

(Continued)

*Primary Examiner*—David Hudspeth
*Assistant Examiner*—Matthew J Sked
(74) *Attorney, Agent, or Firm*—Steven M. Koehler; Westman, Champlin & Kelly, P.A.

(57) ABSTRACT

A method is provided for optimizing an objective measure used to estimate mean opinion score or naturalness of synthesized speech from a speech synthesizer. The method includes using an objective measure that has components derived directly from textual information used to form synthesized utterances. The objective measure has a high correlation with mean opinion score such that a relationship can be formed between the objective measure and corresponding mean opinion score. The objective measure is altered to provide a different function of textual information derived from the utterances so as to improve the relationship between the scores of the objective measure and subjective ratings of the synthesized utterances.

25 Claims, 8 Drawing Sheets

OTHER PUBLICATIONS

Bou-Ghazale et al, "HMM-Based Stressed Speech Modeling with Application to Improved Synthesis and Recognition of Isolated Speech Under Stress", IEE transactions on speech and audio processing, vol. 6, No. 3, May 1998.

Wu, S. Pols, L. "A Distance Measure for Objective Quality Evaluation of Speech Communication Channels Using Also Dynamic Spectral Features", Institute of Phonetic Services, Proceedings 20, pp. 27-42, 1996.

Chu, M. et al, "An Objective Measure for Estimating MOS of Synthesized Speech", Eurospeech 2001.

Kitawaki, N. et al, "Objective Quality Evaluation for Low-Bit-Rate Speech Coding Systems", IEEE Journal on Selected Area in Communications, vol. 6, No. 2, Feb. 1988.

Wang S. et al, An Objective Measure for Predicting Subjective Quality of Speech Coders:,IEEE Journal on selected ares on communications, vol. 10,Issue 5, 819-829.

Dimolitsas,S."Objective Speech Distortion Measures and their Relevance to Speech Quality Assessments", IEEE Proceedings,vol. 136,Pt.I,No. 5,Oct. 1989,317-324.

Cotains,L. (2000),"Speech Quality Evaluation for Mobile Networks", Proceeding of 2000 IEEE International Conference on Communication, vol. 3,1530-1534.

Thorpe,L. et al, (1999)"Performance of Current Perceptual Objective Speech Quality Measures",Proceedings of IEEE Workshop on Speech Coding, 1999, 144-146.

Bayya,A. et al, Objective Measures for Speech Quality Assessment in Wireless Communications:,Proceedings of ICASSP 96,vol. 1, 495-498.

Kitawaki,N. et al, "Quality Assessment of Speech Coding and Speech Synthesis Systems", Communications Magazine, IEEE,vol. 26, Issue 10, Oct. 1988, 36-44.

Chu, M., Peng, H., Yang, H. and Chang, E., "Selecting non-uniform units from a very large corpus for concatenative speech synthesizer", *Proceedings of ICASSP2001*, 2001.

Chu, M., Li, C., Peng, H. and Chang, E., "Domain adaptation for TTS systems", *Proceedings of ICASSP2002*, 2002.

"Optimization Toolbox User's Guide: For Use with Matlab", pp. 1-48 and Index pp. 11-15.

* cited by examiner

OPTIMIZATION OF AN OBJECTIVE MEASURE FOR ESTIMATING MEAN OPINION SCORE OF SYNTHESIZED SPEECH

BACKGROUND OF THE INVENTION

The present invention relates to speech synthesis. In particular, the present invention relates to an objective measure for estimating naturalness of synthesized speech.

Text-to-speech technology allows computerized systems to communicate with users through synthesized speech. The quality of these systems is typically measured by how natural or human-like the synthesized speech sounds.

Very natural sounding speech can be produced by simply replaying a recording of an entire sentence or paragraph of speech. However, the complexity of human languages and the limitations of computer storage may make it impossible to store every conceivable sentence that may occur in a text. Instead, systems have been developed to use a concatenative approach to speech synthesis. This concatenative approach combines stored speech samples representing small speech units such as phonemes, diphones, triphones, syllables or the like to form a larger speech signal unit.

Evaluating the quality of synthesized speech contains two aspects, intelligibility and naturalness. Generally, intelligibility is not a large concern for most text-to-speech systems. However, the naturalness of synthesized speech is a larger issue and is still far from most expectations.

During text-to-speech system development, it is necessary to have regular evaluations on a naturalness of the system. The Mean Opinion Score (MOS) is one of the most popular and widely accepted subjective measures for naturalness. However, running a formal MOS evaluation is expensive and time consuming. Generally, to obtain a MOS score for a system under consideration, a collection of synthesized waveforms must be obtained from the system. The synthesized waveforms, together with some waveforms generated from other text-to-speech systems and/or waveforms uttered by a professional announcer are randomly played to a set of subjects. Each of the subjects are asked to score the naturalness of each waveform from 1-5 (1=bad, 2=poor, 3=fair, 4=good, 5=excellent). The means of the scores from the set of subjects for a given waveform represents naturalness in a MOS evaluation.

Recently, a method for estimating mean opinion score or naturalness of synthesized speech has been advanced by Chu, M. and Peng, H., in "An objective measure for estimating MOS of synthesized speech", *Proceedings of Eurospeech*2001, 2001. The method includes using an objective measure that has components derived directly from textual information used to form synthesized utterances. The objective measure has a high correlation with the mean opinion score such that a relationship can be formed between the objective measure and the corresponding mean opinion score. An estimated mean opinion score can be obtained easily from the relationship when the objective measure is applied to utterances of a modified speech synthesizer.

The objective measure can be based on one or more factors of the speech units used to create the utterances. The factors can include the position of the speech unit in a phrase or word, the neighboring phonetic or tonal context, the spectral mismatch of successive speech units or the stress level of the speech unit. Weighting factors can be used since correlation of the factors with mean opinion score has been found to vary between the factors.

By using the objective measure it is easy to track performance in naturalness of the speech synthesizer, thereby allowing efficient development of the speech synthesizer. In particular, the objective measure can serve as criteria for optimizing the algorithms for speech unit selection and speech database pruning.

Although the objective measure discussed above has proven to replicate, to a great extent, the perceptual behavior of human beings, it might not be optimal. Accordingly, improvements in the objective measure would be desirable in order to objectively and accurately measure the naturalness of synthesized speech.

SUMMARY OF THE INVENTION

A method is provided for optimizing an objective measure used to estimate mean opinion score or naturalness of synthesized speech from a speech synthesizer. The method includes using an objective measure that has components derived directly from textual information of the text to be synthesized and the textual information of the scripts of the pre-stored stored speech segments. The objective measure has a high correlation with mean opinion score such that a relationship can be formed between the objective measure and corresponding mean opinion score. The objective measure is altered to provide a different function of textual information derived from the utterances so as to improve the relationship between the scores of the objective measure and mean opinion score or subjective ratings of the synthesized utterances.

By using the objective measure it is easy to track performance in naturalness of the speech synthesizer, thereby allowing efficient development of the speech synthesizer. In particular, the objective measure can serve as criteria for optimizing the algorithms for speech unit selection and speech database pruning.

The objective measure can be based on one or more textual factors, alone or in combination, of the speech units used to create the utterances. The factors can include the position of the speech unit in a phrase or word, the neighboring phonetic or tonal context, the spectral mismatch of successive speech units or the stress level of the speech unit.

Typically, the textual factors have categorical values, where distances between source categories and target ones are empirically defined as values in distance tables. In a further embodiment, the method includes altering the values in the distance tables. Other forms of altering include adding one or more textual factors and/or one or more higher-order components (combinations of the single-order textual factors) into the objective measure or optimizing a weighting value for each component in the objective measure.

A correlation is obtained between the objective measure and the mean opinion score. The correlation between the altered or new objective measure and the mean opinion score serves as a measure for the validity of any change in the objective measure. Altering of the objective measure and repeated calculation thereof can be repeated as necessary until an optimized objective measure is realized. It is important to note that only a single run of mean opinion scores and recording of the textual information of the synthesized sentences is needed. The results of the subjective evaluation can be used repeatedly.

DETAILED DESCRIPTION OF ILLUSTRATIVE EMBODIMENT

Figure 1:
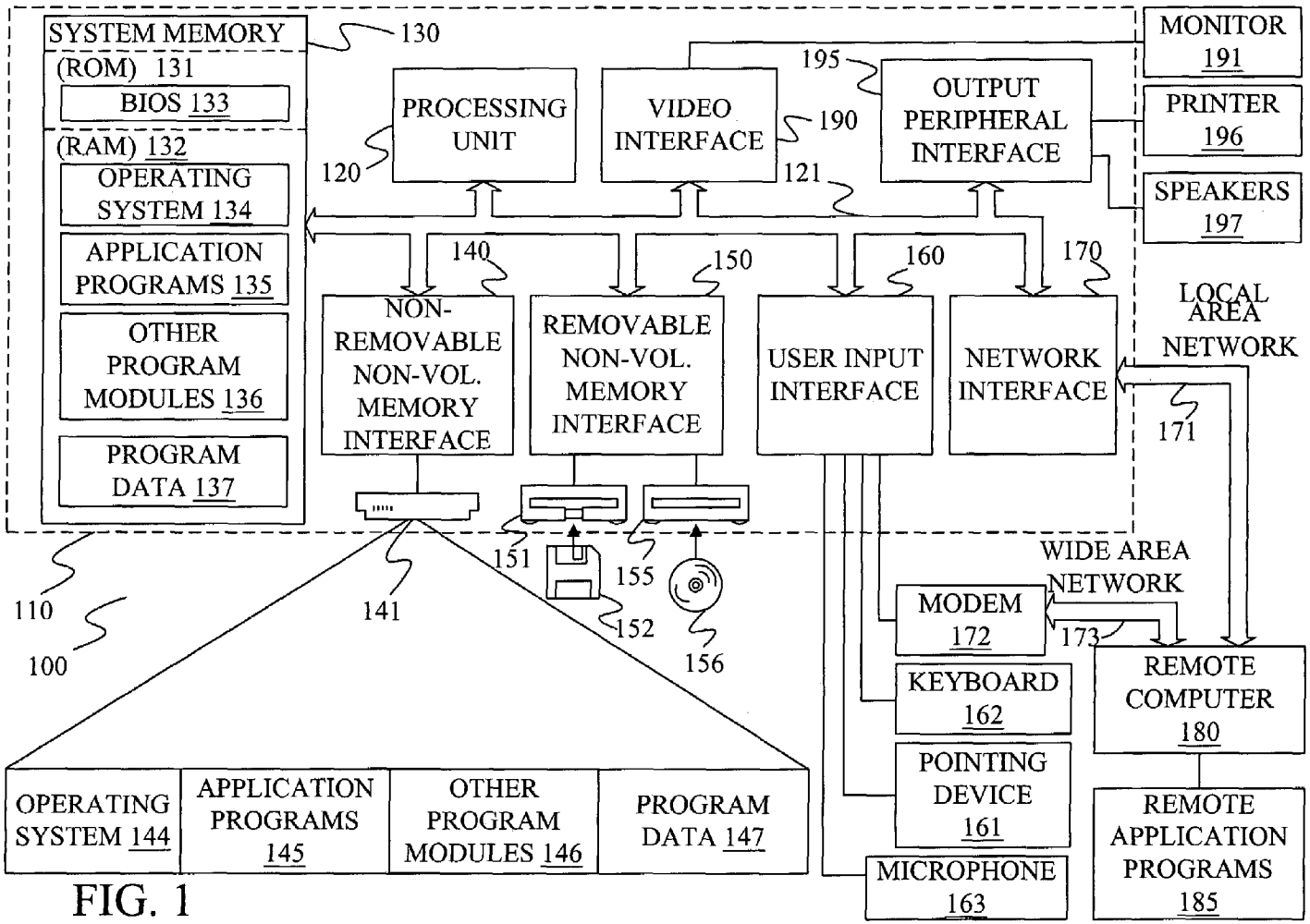
FIG. 1 is a block diagram of a general computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. Tasks performed by the programs and modules are described below and with the aid of figures. Those skilled in the art can implement the description and figures as processor executable instructions, which can be written on any form of a computer readable media.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 100.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, FR, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 190.

The computer 110 may operate in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
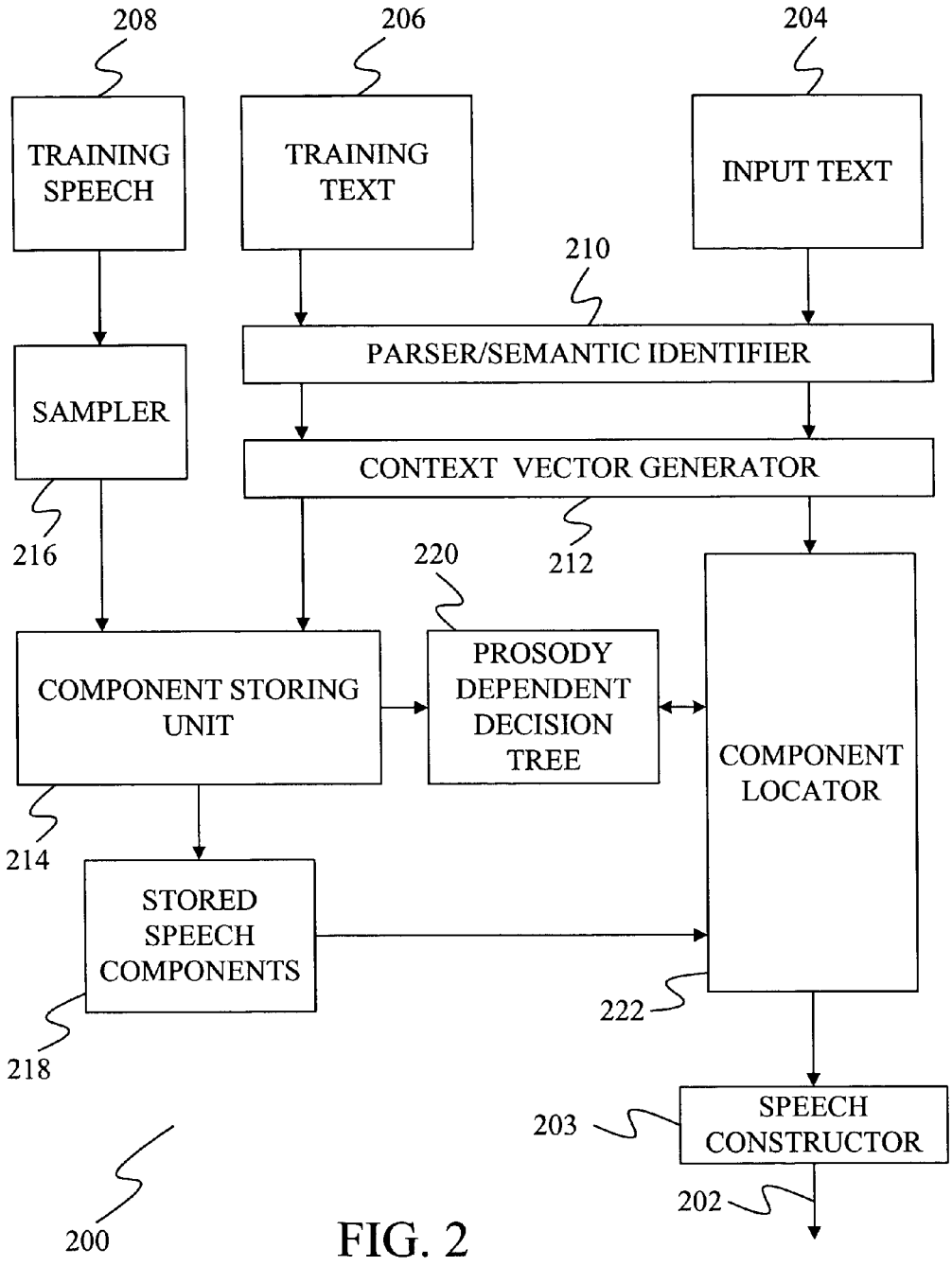
FIG. 2 is a block diagram of a speech synthesis system.

To further help understand the usefulness of the present invention, it may helpful to provide a brief description of a speech synthesizer 200 illustrated in FIG. 2. However, it should be noted that the synthesizer 200 is provided for exemplary purposes and is not intended to limit the present invention.

FIG. 2 is a block diagram of speech synthesizer 200, which is capable of constructing synthesized speech 202 from input text 204. In conventional concatenative TTS systems, a pitch and duration modification algorithm, such as PSOLA, is applied to pre-stored units to guarantee that the prosodic features of synthetic speech meet the predicted target values. These systems have the advantages of flexibility in controlling the prosody. Yet, they often suffer from significant quality decrease in naturalness. In the TTS system 200, speech is generated by directly concatenating speech segments (for speech units such as syllables, phonemes, diphones, semiphones, etc.) without any pitch or duration modification under the assumption that the speech database contains enough prosodic and spectral varieties for all speech units and the best fitting segments can always be found.

However, before speech synthesizer 200 can be utilized to construct speech 202, it must be initialized with samples of speech units taken from a training text 206 that are read into speech synthesizer 200 as training speech 208.

Initially, training text 206 is parsed by a parser/semantic identifier 210 into strings of individual speech units attached with various textual information. Under some embodiments of the invention, especially those used to form Chinese speech, the speech units are tonal syllables. However, other speech units such as phonemes, diphones, triphones or the mix of them may be used within the scope of the present invention.

Parser/semantic identifier 210 also identifies high-level prosodic information about each sentence provided to the parser 210. This high-level prosodic information includes the predicted tonal levels for each speech unit as well as the grouping of speech units into prosodic words and phrases. In embodiments where tonal syllable speech units are used, parser/semantic identifier 210 also identifies the first and last phoneme in each speech unit.

The strings of speech units attached with textual and prosodic information produced from the training text 206 are provided to a context vector generator 212, which generates a Speech-unit Dependent Descriptive Contextual Variation Vector (SDDCVV, hereinafter referred to as a "context vector"). The context vector describes several context variables that can affect the naturalness of the speech unit. Under one embodiment, the context vector describes six variables or coordinates of textual information. They are:

- Position in phrase (PinP): the position of the current speech unit in its carrying prosodic phrase.
- Position in word (PinW): the position of the current speech unit in its carrying prosodic word.
- Left phonetic context (LPhC): category of the last phoneme in the speech unit to the left (preceding) of the current speech unit.
- Right phonetic context (RPhC): category of the first phoneme in the speech unit to the right (following) of the current speech unit.
- Left tone context (LTC): the tone category of the speech unit to the left (preceding) of the current speech unit.
- Right tone context (RTC): the tone category of the speech unit to the right (following) of the current speech unit.

If desired, the coordinates of the context vector can also include the stress level of the current speech unit, the tonal identity of current speech unit or the coupling degree of its pitch, duration and/or energy with its neighboring units.

Under one embodiment, the position in phrase coordinate and the position in word coordinate can each have one of four values, the left phonetic context can have one of eleven values, the right phonetic context can have one of twenty-six values and the left and right tonal contexts can each have one of two values.

The context vectors produced by context vector generator 212 are provided to a component storing unit 214 along with speech samples produced by a sampler 216 from training speech signal 208. Each sample provided by sampler 216 corresponds to a speech unit identified by parser 210. Component storing unit 214 indexes each speech sample by its context vector to form an indexed set of stored speech components 218.

The samples are indexed, for example, by a prosody-dependent decision tree (PDDT), which is formed automatically using a classification and regression tree (CART). CART provides a mechanism for selecting questions that can be used to divide the stored speech components into small groups of similar speech samples. Typically, each question is used to divide a group of speech components into two smaller groups. With each question, the components in the smaller groups become more homogenous. Grouping of the speech units is not directly pertinent to the present invention and a detailed discussion for forming the decision tree is provided in application "METHOD AND APPARATUS FOR SPEECH SYNTHESIS WITHOUT PROSODY MODIFICATION", filed May 7, 2001 and assigned Ser. No. 09/850,527.

Generally, when the decision tree is in its final form, each leaf node will contain a number of samples for a speech unit. These samples have slightly different prosody from each other. For example, they may have slightly different pitch contours and durations from each other. By maintaining these minor differences within a leaf node, the speech synthesizer 200 introduces slight diversity in prosody, which is helpful in removing monotonous prosody. A set of stored speech samples 218 is indexed by decision tree 220. Once created, decision tree 220 and speech samples 218 can be used to generate concatenative speech without requiring prosody modification.

The process for forming concatenative speech begins by parsing input text 204 using parser/semantic identifier 210 and identifying high-level prosodic information for each speech unit produced by the parse. This prosodic information is then provided to context vector generator 212, which generates a context vector for each speech unit identified in the parse. The parsing and the production of the context vectors are performed in the same manner as was done before in the training of prosody decision tree 220.

The context vectors are provided to a component locator 222, which uses the vectors to identify a set of samples for the sentence. Under one embodiment, component locator 222 uses a multi-tier non-uniform unit selection algorithm to identify the samples from the context vectors.

Figure 3:
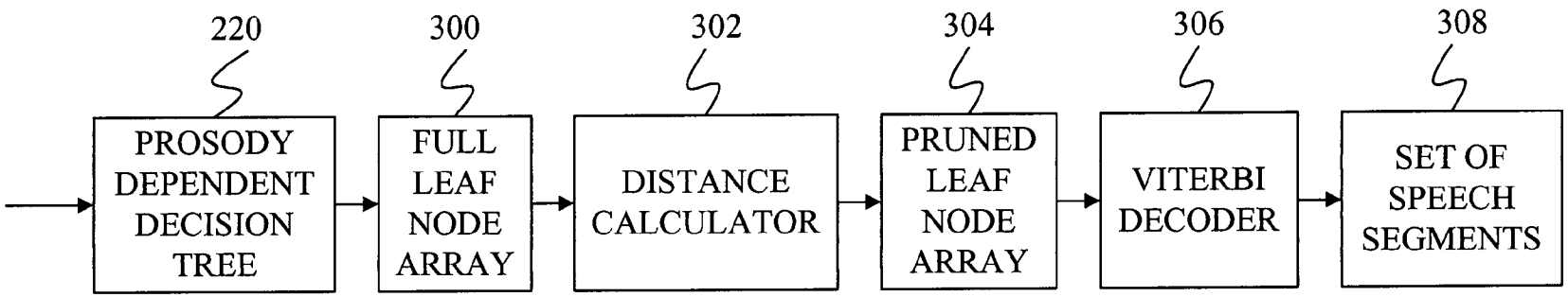
FIG. 3 is a block diagram of a selection system for selecting speech segments.
Figure 4:
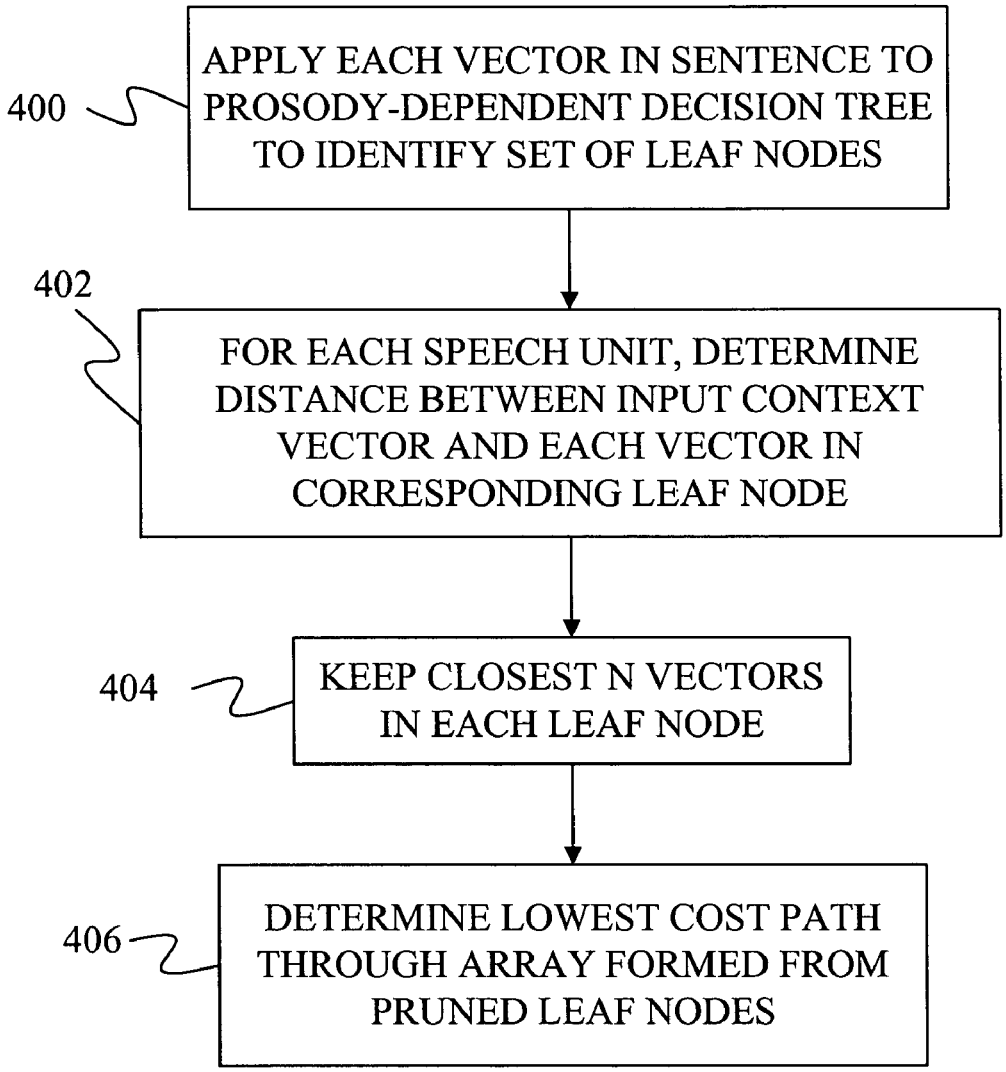
FIG. 4 is a flow diagram of a selection system for selecting speech segments.

FIGS. 3 and 4 provide a block diagram and a flow diagram for a multi-tier non-uniform selection algorithm. In step 400, each vector in the set of input context vectors is applied to prosody-dependent decision tree 220 to identify a leaf node array 300 that contains a leaf node for each context vector. At step 402, a set of distances is determined by a distance calculator 302 for each input context vector. In particular, a separate distance is calculated between the input context vector and each context vector found in its respective leaf node. Under one embodiment, each distance is calculated as:

$$D_c = \sum_{i=1}^{I} W_{ci} D_i \qquad \text{EQ. 1}$$

where $D_c$ is the context distance, $D_i$ is the distance for coordinate i of the context vector, $W_{Ci}$ is a weight associated with coordinate i, and I is the number of coordinates in each context vector.

At step 404, the N samples with the closest context vectors to the target are retained while the remaining samples are pruned from node array 300 to form pruned leaf node array 304. The number of samples, N, to leave in the pruned nodes is determined by balancing improvements in prosody with improved processing time. In general, more samples left in the pruned nodes means better prosody at the cost of longer processing time.

At step 406, the pruned array is provided to a Viterbi decoder 306, which identifies a lowest cost path through the pruned array. Although the sample with the closest context vector in each node could be selected, using a multi-tier approach, the cost function is:

$$C_c = W_c \sum_{j=1}^{J} D_{cj} + W_s \sum_{j=1}^{J} C_{sj} \qquad \text{EQ. 2}$$

where $C_c$ is the concatenative cost for the entire sentence or utterance, $W_c$ is a weight associated with the distance measure of the concatenated cost, $D_{cj}$ is the distance calculated in equation 1 for the $j^{th}$ speech unit in the sentence, $W_s$ is a weight associated with a smoothness measure of the concatenated cost, $C_{sj}$ is a smoothness cost for the $j^{th}$ speech unit, and J is the number of speech units in the sentence.

The smoothness cost in Equation 2 is defined to provide a measure of the spectral mismatch between sample j and the samples proposed as the neighbors to sample j by the Viterbi decoder. Under one embodiment, the smoothness cost is determined based on whether a sample and its neighbors were found as neighbors in an utterance in the training corpus. If a sample occurred next to its neighbors in the training corpus, the smoothness cost is zero since the samples contain the proper spectral transition in between. If a sample did not occur next to its neighbors in the training corpus (referred as non-neighboring case), the smoothness cost is set to one. Under another embodiment, different values are assigned to the smoothness cost for non-neighboring cases according to their boundary types. For example, if the boundary between the two segments is sonorant to sonorant, the largest cost (1) is given. If the boundary between them is non-sonorant consonant to non-sonorant consonant, a small cost (0.2) is given. The cost between sonorant to non-sonorant or non-sonorant to sonorant transition is in middle (0.5). The different smoothness costs lead the search algorithm to prefer concatenation at boundaries with smaller cost.

Using the multi-tier non-uniform approach, if a large block of speech units, such as a word or a phrase, in the input text exists in the training corpus, preference will be given to selecting all of the samples associated with that block of speech units. Note, however, that if the block of speech units occurred within a different prosodic context, the distance between the context vectors will likely cause different samples to be selected than those associated with the block.

Once the lowest cost path has been identified by Viterbi decoder 306, the identified samples 308 are provided to speech constructor 203. With the exception of small amounts of smoothing at the boundaries between the speech units, speech constructor 203 simply concatenates the speech units to form synthesized speech 202.

Figure 5:
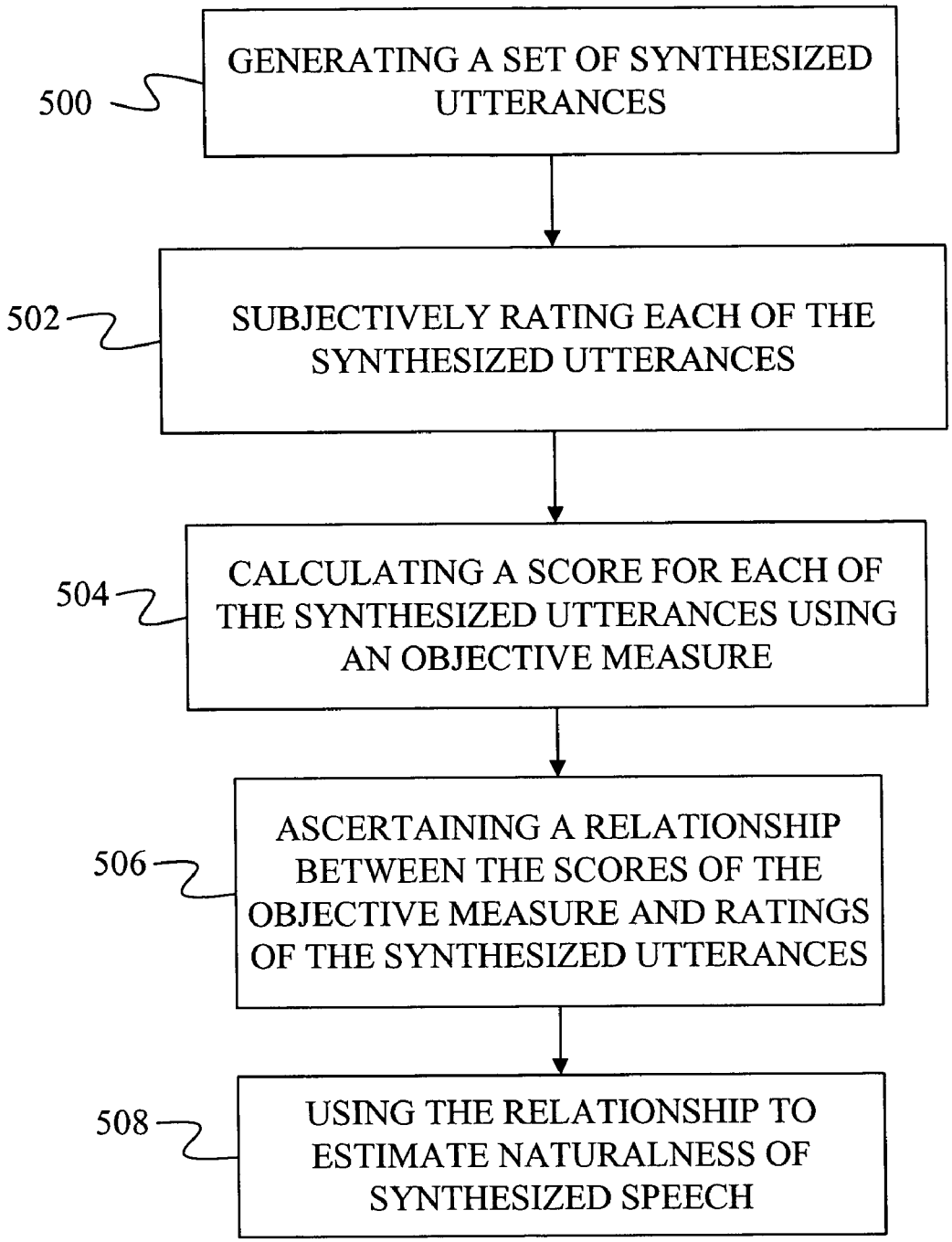
FIG. 5 is a flow diagram for estimating mean opinion score from an objective measure.

As discussed in the Background section, the evaluation of concatenative cost can form the basis of an objective measure for MOS estimation. A method for using the objective measure in estimating MOS is illustrated in FIG. 5. Generally, the method includes generating a set of synthesized utterances at step 500, and subjectively rating each of the utterances at step 502. A score is then calculated for each of the synthesized utterances using the objective measure at step 504. The scores from the objective measure and the ratings from the subjective analysis are then analyzed to determine a relationship at step 506. The relationship is used at step 508 to estimate naturalness or MOS when the objective measure is applied to the textual information of speech units for another utterance or second set of utterances from a modified speech synthesizer (e.g. when a parameter of the speech synthesizer has been changed). It should be noted that the words of the "another utterance" or the "second set of utterances" obtained from the modified speech synthesizer can be the same or different words used in the first set of utterances.

In one embodiment, in order to make the concatenative cost comparable among utterances with variable number of syllables, the average concatenative cost of an utterance is used and can be expressed as:

$$C_a = \sum_{i=1}^{I+1} W_i C_{ai} \qquad \text{EQ. 3}$$

$$C_{ai} = \begin{cases} \frac{1}{J}\sum_{l=1}^{J} D_i(l), & i = 1, \cdots, I \\ \frac{1}{J-1}\sum_{l=1}^{J-1} C_s(l), & i = I+1 \end{cases}$$

$$W_i = \begin{cases} W_{ci}W_c & i = 1, \cdots, I \\ W_s & i = I+1 \end{cases}$$

where, $C_a$ is the average concatenative cost and $C_{ai}$ (i=1, . . . ,7) one or more of the factors that contribute to $C_a$, which are, in the illustrative embodiment, the average costs for position in phrase ("PinP"), position in word ("PinW"), left phonetic context ("LPhC"), right phonetic context ("RPhC"), left tone context ("LTC"), right tone context ("RTC") and smoothness cost per unit in an utterance.

The cost function as provided above is a weighted sum of seven factors. Six of the factors are distances between the target category and the category of candidate unit (named as unit category) for the six contextual factors, which are PinP, PinW, LPhC, RPhC, LTC and RTC. Since all these factors take only categorical values, the distance between categories are empirically predefined in distance tables. The seventh factor is an enumerated smoothness cost, which takes value 0 when current candidate unit is a continuous segment with the unit before it in the unit inventory and takes value larger than 0 otherwise.

$W_i$ are weights for the seven component-costs and all are set to 1, but can be changed. For instance, it has been found that the coordinate having the highest correlation with mean opinion score was smoothness, whereas the lowest correlation with mean opinion score was position in phase. It is therefore reasonable to assign larger weights for components with high correlation and smaller weights for components with low correlation. In one experiment, the following weights were used:

Position in Phrase, $W_1$=0.10
Position in Word, $W_2$=0.60
Left Phonetic Context, $W_3$=0.10
Right Phonetic Context, $W_4$=0.76
Left Tone Context, $W_5$=1.76
Right Tone Context, $W_6$=0.72
Smoothness, $W_7$=2.96

In one exemplary embodiment, 100 sentences are carefully selected from a 200 MB text corpus so the $C_a$ and $C_{ai}$ (i=1, . . . ,7) of them are scattered into wide spans. Four synthesized waveforms are generated for each sentence with the speech synthesizer 200 above with four speech databases, whose sizes are 1.36 GB, 0.9 GB, 0.38 GB and 0.1 GB, respectively. $C_a$ and $C_{ai}$ of each waveform are calculated. All the 400 synthesized waveforms, together with some waveforms generated from other TTS systems and waveforms uttered by a professional announcer, are randomly played to 30 subjects. Each of the subjects is asked to score the naturalness of each waveform from 1-5 (1=bad, 2=poor, 3=fair, 4=good, 5=excellent). The mean of the thirty scores for a given waveform represents its naturalness in MOS.

Fifty original waveforms uttered by the speaker who provides voice for the speech database are used in this example. The average MOS for these waveforms was 4.54, which provides an upper bound for MOS of synthetic voice. Providing subjects a wide range of speech quality by adding waveforms from other systems can be helpful so that the subjects make good judgements on naturalness. However, only the MOS for the 400 waveforms generated by the speech synthesizer under evaluation are used in conjunction with the corresponding average concatenative cost score.

Figure 6:
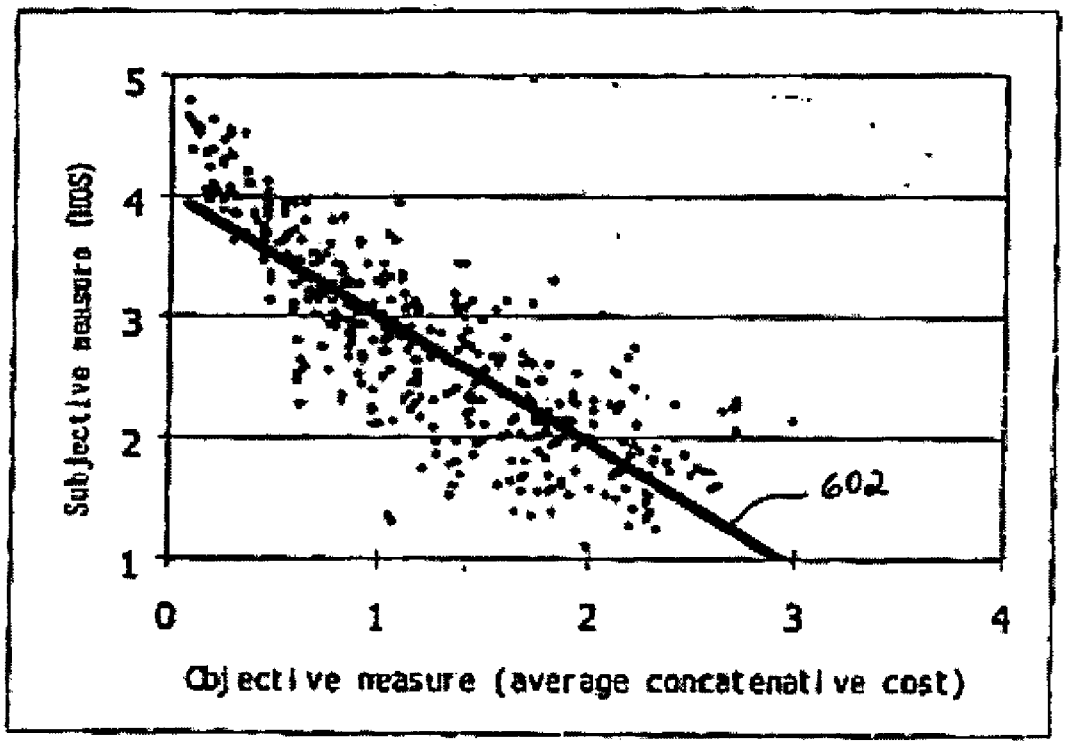
FIG. 6 is a plot of a relationship between mean opinion score and the objective measure.

FIG. 6 is a plot illustrating the objective measure (average concatenative cost) versus subjective measure (MOS) for the 400 waveforms. A correlation coefficient between the two dimensions is −0.822, which reveals that the average concatenative cost function replicates, to a great extent, the perceptual behavior of human beings. The minus sign of the coefficient means that the two dimensions are negatively correlated. The larger $C_a$ is, the smaller the corresponding MOS will be. A linear regression trendline 602 is illustrated in FIG. 6 and is estimated by calculating the least squares fit throughout points. The trendline or curve is denoted as the average concatenative cost-MOS curve and for the exemplary embodiment is:

$$Y=-1.0327x+4.0317.$$

However, it should be noted that analysis of the relationship of average concatenative cost and MOS score for the representative waveforms can also be performed with other curve-fitting techniques, using, for example, higher-order polynomial functions. Likewise, other techniques of correlating average concatenative cost and MOS can be used. For instance, neural networks and decision trees can also be used.

Using the average concatenative cost vs. MOS relationship, an estimate of MOS for a single synthesized speech waveform can be obtained by its average concatenative cost. Likewise, an estimate of the average MOS for a TTS system can be obtained from the average of the average of the concatenative costs that are calculated over a large amount of synthesized speech waveforms. In fact, when calculating the average concatenative cost, it is unnecessary to generate the speech waveforms since the costs can be calculated after the speech units have been selected.

Although the concatenative cost function has proven to replicate, to a great extent, the perceptual behavior of human beings, it might not be optimal. It has been discovered by the inventors that some factors that can contribute to inaccuracies in the concatenative cost function include that many parameters in the cost function are assigned empirically by a human expert, and accordingly, they might not be the most suitable values. In addition, the concatenative cost function provided above contains only first order components of the seven textual factors, yet, higher order interactions might exist among these factors. Furthermore, there might be other components that could be added into the concatenative cost function.

Figure 7:
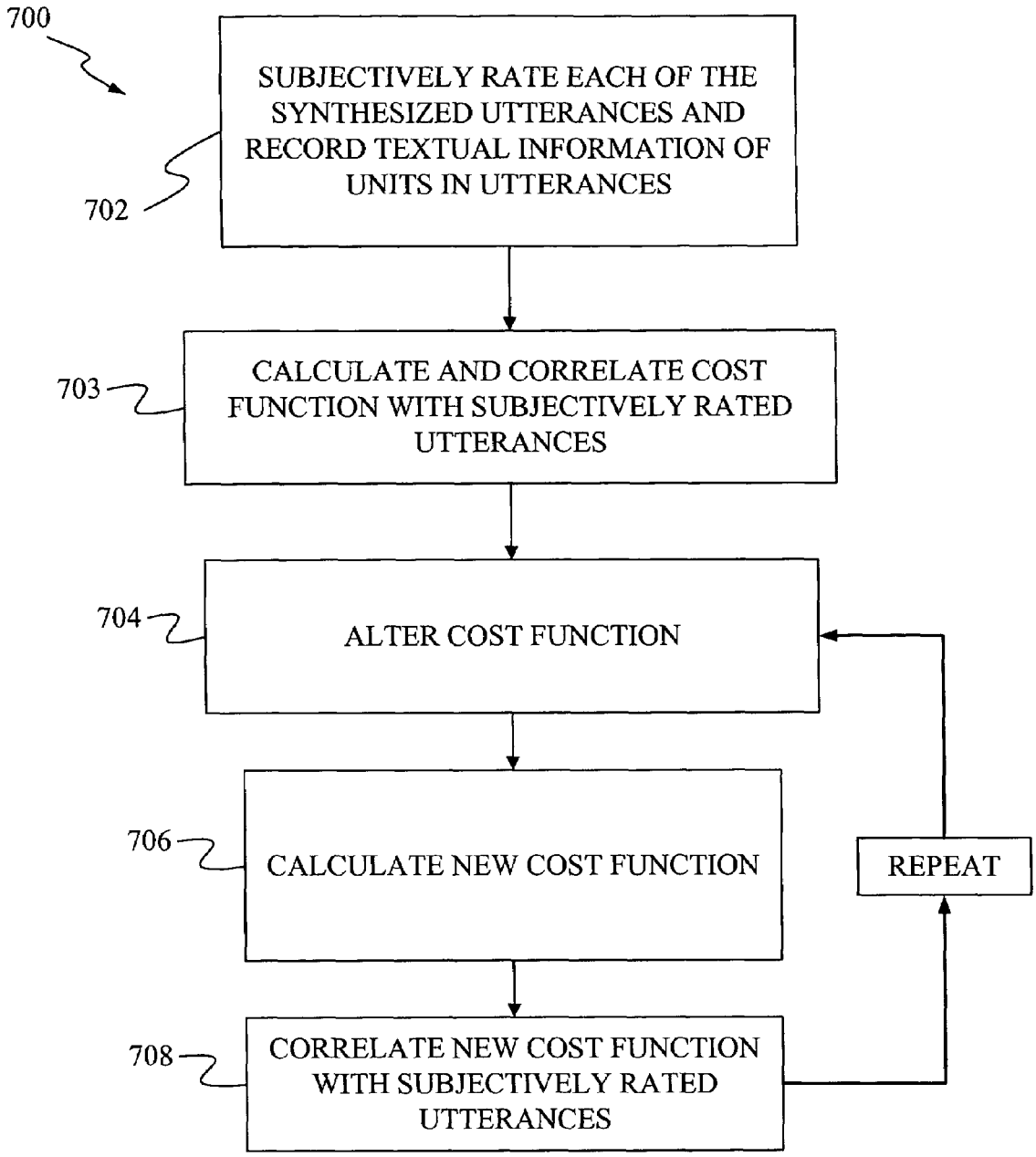
FIG. 7 is a flow diagram illustrating a method for optimizing the objective measure.

One aspect of the present invention is a method for optimizing the objective measure or concatenative cost function for unit selection in the corpus-based TTS system by maximizing the correlation between the concatenative cost and the MOS. The method is illustrated in FIG. 7 at 700. At step 702, a subjective evaluation should be done first as discussed above. However, a beneficial aspect of this step is to log or record in a file or other means the textual information of all units appearing in the synthetic utterances evaluated. At step 703, an initial concatenative cost function is used and a correlation with MOS is established. At step 704, the concatenative cost function is altered, for example, using any one or more of the techniques described below. With the recorded log file, a new concatenative cost can be recalculated at step 706 using the new a cost function. The correlation between the new concatenative cost and MOS is obtained at step 708, which also serves as a measure for the validity of any change in the concatenative cost function. Steps 704, 706 and 708 can be repeated as necessary until an optimized concatenative cost function is realized. It is important to note that only a single run of MOS evaluation (step 702) is required in the optimization method 700. This is helpful because step 702 can be particularly labor and time consuming. Other optimization algorithms such as Gradient Declination can also be used to optimize the free parameters.

As indicated above, in order to evaluate improvements and accuracy made to the cost function, a measure needs to be used. One useful measure has been found to be the correlation between the concatenative cost and the MOS such as illustrated in FIG. 6. Thus, if the correlation between concatenative cost and MOS improves with changes to the concatenative cost function, such changes can be included in the concatenative cost function.

As mentioned above, the log file of step 702 keeps the information of the target units wanted and the units actually used. Concatenative cost for all sentences can be calculated with any new cost function from the log file. That is to say, the form of the cost function or the distance tables used by the cost function can be changed, and the validity of the change can be measured through movement of the correlation between the new cost and the MOS for the set of synthesized utterances. Furthermore, when a specific format is given to a cost function, the correlation between concatenative cost and MOS can be treated as a function of the parameters of the concatenative cost function, denoted by the following equation $$\text{Corr}=f(x_1,x_2,\ldots,x_N) \qquad \text{EQ. 4}$$

where, N is number of free parameters in the concatenative cost function. If the concatenative cost function is defined as equation (3), distances between target and unit categories for the six textual factors and the weights for the seven factors can be free parameters. An optimization routine is used to optimize the free parameters so that the largest correlation is to be achieved. One suitable optimization routine that can be used is the function "fmincon" in the Matlab Optimization Toolbox by The MathWorks, Inc. of Natick, Mass., U.S.A ("Optimization Toolbox User's Guide: For Use with MATLAB"), which searches for the minimum of a constrained nonlinear multivariable function, and optimizes the free parameters so that the largest correlation is to be achieved. Since concatenative cost and MOS is negatively correlated, Corr in equation 4 is to be minimized.

Figure 8:
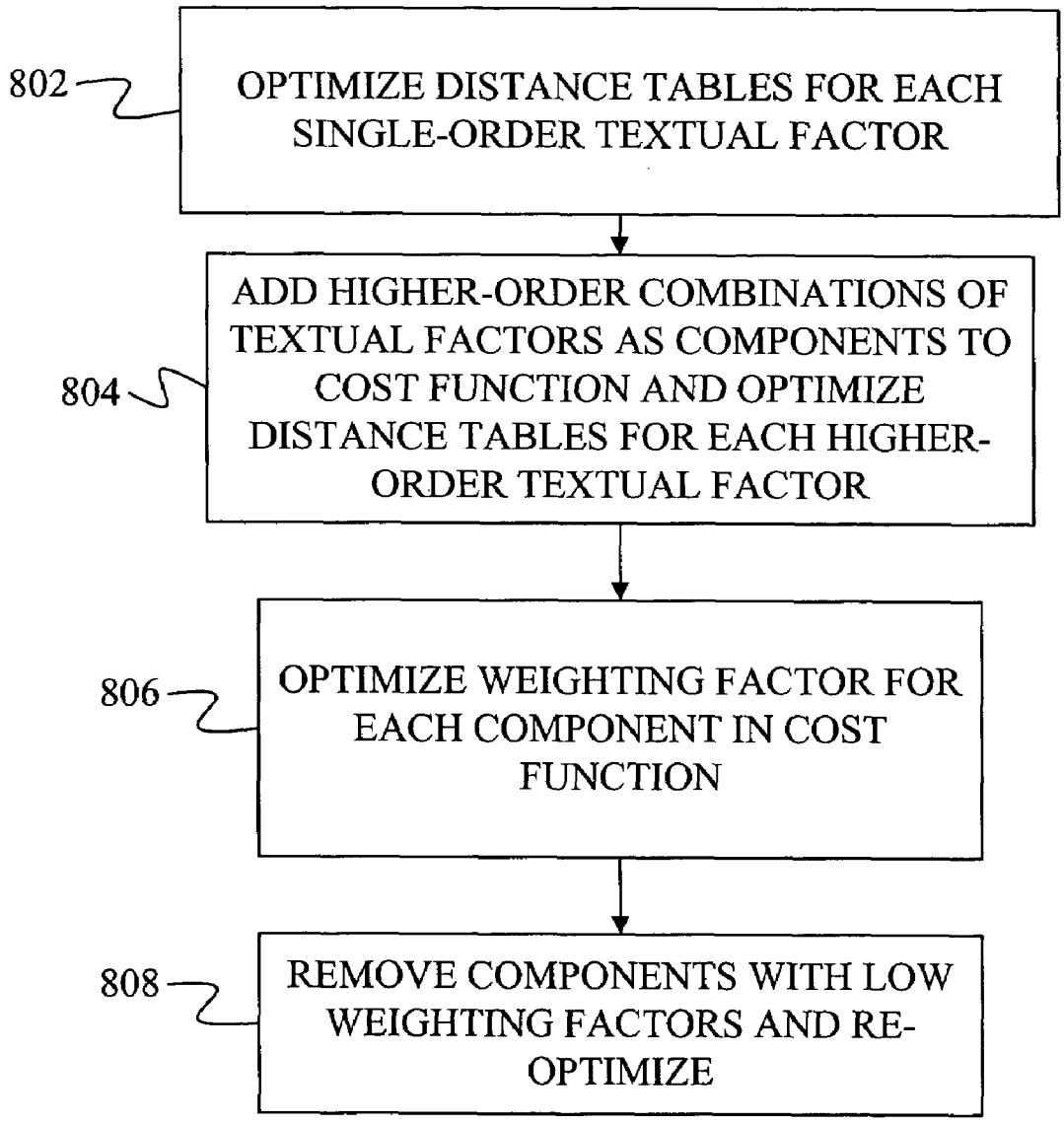
FIG. 8 is a flow diagram illustrating an exemplary method of optimizing the objective measure.

In one embodiment, for instance, depending on the number of utterances available with MOS scores, the number of free parameters in each run of optimization should not be too large. Thus, in one embodiment, optimization can be separated into many runs. In each run at step 704, only some of the parameters are optimized and the others are fixed at their original values. Referring to FIG. 8, three different kinds of changes can be made to the concatenative cost function; specifically optimize the distance tables for the six single-order textual factors individually at step 802; explore the interactions among factors and add some higher order components into the cost function at step 804; and optimize the weight for each component in the new cost function at step 806.

Since some parameters in the distance tables may not be used frequently depending on the number of available sentences, optimizing them with a few observations will probably cause an overfitting problem. In this case, to avoid overfitting, a threshold can be set for the number of times a parameter had been used. Only frequently used ones are optimized. Though, no globally optimized solution is guaranteed, it is quite likely that the overall correlation is increased.

In order to check the validity of the optimized parameters, a K-fold cross validation experiment is done. In one embodiment, K is set to 4. In each run of optimization, only 300 utterances are used for training and the remaining 100 sentences are used for testing. If the difference between average correlation coefficients for the training and testing set is large, the optimization is considered invalid. Thus, the number of free parameters should be reduced. For valid optimization, means of the four sets of optimized parameters are used in the final cost function.

As indicated above, the distances between target categories and unit categories of a textual factor are assigned manually, which may not be the most suitable values. In a first method of optimization of the concatenative cost function, the distance table for each textual factor is improved at step 802 individually. Here, the concatenative cost function contains only a single textual component in each run of optimization. The correlation coefficients between the six textual factors and MOS before and after optimization are listed in Table 1.

TABLE 1

| | IniCorr | TrCorr | TsCorr |
|---|---|---|---|
| PinP | 0.498 | 0.525 | 0.498 |
| PinW | 0.623 | 0.631 | 0.623 |
| LPhC | 0.553 | 0.715 | 0.703 |
| RPhC | 0.688 | 0.742 | 0.736 |
| LTC | 0.654 | 0.743 | 0.731 |
| RTC | 0.622 | 0.755 | 0.732 |

In Table 1, the correlation coefficients between the six textual factors and MOS before and after optimization are provided where "IniCorr" provides the initial coefficient obtained with the empirical distance tables; "TrCorr" provides the average coefficient on the four training sets after optimization; and "TsCorr" provides the average coefficient on testing sets after optimization.

It can be seen that there is no change for the correlation for the factor PinP and PinW on the testing set, and both of them have smaller correlation to MOS than other factors.

The reason might be that both of them have been used in the splitting question for constructing indexing CART for the unit inventory. Thus, most of the units used in subjective experiment have zero distances for the two factors. For the other four factors, great increases are obtained.

Using the factor RTC by way of example for detailed explanation, the initial distance table and the optimized one for RTC are given in Table 2(a) and 2(b) below. T1-T5 represent the four normal tones and the neutral tone in Mandarin Chinese. Rows in Tables 2(a) and 2(b) represent the target RTC, while the columns represent the unit RTC. The numbers in the tables are the distances between target RTC and unit RTC. It can be seen that many distances reach a more precise value after optimization, in comparison to those given by a human expert. There are some numbers unchanged in Table 2(b) since they haven't been used enough times in the training set. Thus, they are fixed at the initial values during the optimizing phase.

TABLE 2(a)

The initial distance table

| | Target RTC | | | | |
|---|---|---|---|---|---|
| Unit RTC | T1 | T2 | T3 | T4 | T5 |
| T1 | 0 | 0.25 | 0.75 | 0.25 | 1 |
| T2 | 0.5 | 0 | 0.25 | 0.75 | 1 |
| T3 | 0.5 | 0.25 | 0 | 0.75 | 1 |
| T4 | 0.75 | 0.5 | 1 | 0 | 0.25 |
| T5 | 0.5 | 0.75 | 1 | 0.25 | 0 |

TABLE 2(b)

The optimized distance table

| | Target RTC | | | | |
|---|---|---|---|---|---|
| Unit RTC | T1 | T2 | T3 | T4 | T5 |
| T1 | 0 | 0.25 | 0.75 | 0.93 | 0.27 |
| T2 | 0.62 | 0 | 0.37 | 0.95 | 1 |
| T3 | 0.5 | 0.88 | 0 | 0.75 | 1 |
| T4 | 0.87 | 0.56 | 1 | 0 | 0.58 |
| T5 | 0.5 | 0.75 | 1 | 0.66 | 0 |

As provided above in equation 3, the concatenative cost function is a linear combination of the seven factors. Yet, it has been discovered some of them may have interactions. However, to limit the number of free parameters, the numbers of categories for the six textual factors can be reduced, if desired. In the discussion provided below, the number of categories for PinP and PinW have been reduced to 2, while LPhC have been reduced to 4 and RPhC, LTC and RTC have been reduced to 3, although this should not be considered necessary or limiting. In the exemplary optimization method discussed herein, six second-order combinations (i.e. combinations of two textual factors) are investigated at step 804, in which the maximum number of free parameters is 36; however it should be understood other combinations and/or even higher order combinations (combinations of three or more textual factors) can also be used. In the present discussion, the combination between LPhC and other factors has not been adopted since these combinations may cause too many free parameters.

As with the single-order components of the cost function, the higher-order components also take only categorical values, the distance between categories are empirically predefined in distance tables. After optimizing the distance tables for these second-order components individually in a manner similar to that discussed above with the single-order textual factors in step 804, their correlation coefficients to MOS are listed in Table 3. Comparing Table 3 to Table 1, it can be seen that all combinations of Table 3 have a higher correlation than using PinP and PinW alone, yet, only coefficients for LTC-PinW and LTC-PinW pairs are higher than those of using LTC alone. It appears that some of the second-order components play important roles for unit selection. In a further embodiment discussed below, all of the higher-order components are used to form the concatenative cost function at first and some of them are then removed after optimizing the weights since they receive small weights.

TABLE 3

| | RPhC | LTC | RTC |
|---|---|---|---|
| PinP | 0.719 | 0.752 | 0.710 |
| PinW | 0.751 | 0.790 | 0.745 |

An enumerated smoothness cost is used in the original cost function. Various smoothness costs based on the combinations with the six textual factors have been investigated. In one embodiment, it has been found beneficial to assign the smoothness cost by considering PinW (2 categories), LTC (3 categories) and the final type of current unit (3 categories). That is to say, when the current unit is a continuous segment of its previous segment in the unit inventory, its smoothness cost is set to be zero, otherwise, it is to be assigned a value from a table of 18(=2*3*3) possibilities according the conditions described above. The values in the smoothness cost table can be optimized by maximizing the correlation between smoothness cost and MOS in the training sets, e.g. four training sets. After optimization, the correlation coefficient reaches 0.883, which is higher than the old one, 0.846. This reveals that the new smoothness cost is more suitable than the original one and is used to replace the original one in the cost function discussed below.

Since it is not generally known which component is more important, at first, the new cost function in step 806 is formed by weighted sum of all the single-order components and higher-order components as discussed above. The weights for each of the components are then optimized as discussed above. An example of optimized weights for 13 components is provided in Table 4. Since some of the components received very small weights, they can be removed from the cost function without much effect. In a further embodiment, step 808 includes removing some components below a selected threshold and keeping only the more significant components (identified with stars), wherein the weights of the remaining components are optimized again. The new optimized weights in the final concatenative cost function for seven components are given in Table 5. The correlation coefficient between the final cost and MOS reaches 0.897, which is much higher than the original one, 0.822. Speech synthesized with the new cost function should sound more natural than that generated with the original one.

TABLE 4

| Component | Weight | Component | Weight |
|---|---|---|---|
| PinP | 0.008 | RPhC-PinP pair | 0.008 |
| PinW | 0.008 | RPhC-PinW pair | 0.023 |

TABLE 4-continued

| Component | Weight | Component | Weight |
|---|---|---|---|
| LPhC* | 0.099 | LTC-PinP pair* | 0.088 |
| RPhC* | 0.054 | LTC-PinW pair* | 0.113 |
| LTC* | 0.104 | RTC-PinP pair | 0.008 |
| RTC* | 0.091 | RTC-PinW pair | 0.016 |
| | | New smooth cost* | 0.380 |

TABLE 5

| Component | Weight | Component | Weight |
|---|---|---|---|
| LPhC | 0.061 | LTC-PinP pair | 0.122 |
| RPhC | 0.059 | LTC-PinW pair | 0.170 |
| LTC | 0.016 | New smooth cost | 0.481 |
| RTC | 0.091 | | |

At this point it should be noted the utterances used for the MOS experiment should be designed carefully so that units have wide coverage for textual factors. In the example discussed above, prosodic feature orientated CART indices have been adopted for all units, where most of the units used in the MOS evaluation take zero costs for their PinP and PinW factors. Thus, the two factors show smaller correlations to MOS, though they can be important factors. On the other hand, optimization using 400 utterances is not enough for training all the parameters. If possible, a larger scale MOS evaluation can be used to get more reliable optimized parameters. Since the result of MOS evaluation can be used perpetually, (i.e. over and over), it may be worthwhile to do a well-designed large-scale MOS evaluation.

Although the present invention has been described with reference to particular embodiments, workers skilled in the art will recognize that changes may be made in form and detail without departing from the spirit and scope of the invention. In particular, although context vectors are discussed above, other representations of the context information sets may be used within the scope of the present invention.

What is claimed is:

1. A method for optimizing an objective measure, from which naturalness of synthesized speech can be estimated, wherein naturalness is a subjective quality of synthesized speech, the method comprising:

generating a set of synthesized utterances;

subjectively rating each of the synthesized utterances;

calculating a score for each of the synthesized utterances using an objective measure, the objective measure being a function of textual information derived from the utterances;

ascertaining a relationship between the scores of the objective measure and subjective ratings of the synthesized utterances; and altering the objective measure in a manner beyond only changing one or more weighting factors in the objective measure to provide a different function of textual information derived from the utterances so as to improve the relationship between the scores of the objective measure and subjective ratings of the synthesized utterances.

2. The method of claim 1 wherein the step of altering is repeated, and wherein each repetition includes using the same subjective ratings of the synthesized utterances and textual information of the synthesized utterances.

3. The method of claim 1 wherein the objective measure includes components having categorical values, and wherein a distance between categories are empirically defined as values in distance tables, and wherein altering includes altering the values in the distance tables.

4. The method of claim 1 wherein the objective measure comprises one or more first order components from a set of factors and/or one or more higher order components being combinations of at least two factors from the set of factors, wherein the set of factors include:

an indication of a position of a speech unit in a phrase;

an indication of a position of a speech unit in a word;

an indication of a category for a phoneme preceding a speech unit;

an indication of a category for a phoneme following a speech unit;

an indication of a category for tonal identity of the current speech unit;

an indication of a category for tonal identity of a preceding speech unit;

an indication of a category for tonal identity of a following speech unit; and an indication of a level of stress of a speech unit;

an indication of a coupling degree of pitch, duration and/or energy with a neighboring unit; and an indication of a degree of spectral mismatch with a neighboring speech unit.

5. The method of claim 4 wherein the components of the objective measure include categorical values, and wherein a distance between categories are empirically defined as values in distance tables, and wherein altering includes altering the values in the distance tables.

6. The method of claim 4 wherein components of the objective measure each include a weighting value, and wherein altering includes altering the weighting values.

7. The method of claim 6 wherein altering the objective measure comprises selecting components of the objective measure as a function of the weighting factor of each component.

8. The method of claim 4 wherein altering the objective measure comprises selecting components of the objective measure as a function of its respective correlation to the subjective ratings of the synthesized utterances.

9. The method of claim 1 wherein the objective measure comprises an indication of a position of a speech unit in a phrase.

10. The method of claim 1 wherein the objective measure comprises an indication of a position of a speech unit in a word.

11. The method of claim 1 wherein the objective measure comprises an indication of a category for a phoneme preceding a speech unit.

12. The method of claim 1 wherein the objective measure comprises an indication of a category for a phoneme following a speech unit.

13. The method of claim 1 wherein the objective measure comprises an indication of a category for the tone of a preceding speech unit.

14. The method of claim 1 wherein the objective measure comprises an indication of a category for the tone of a following speech unit.

15. The method of claim 1 wherein the objective measure comprises an indication of a spectral mismatch between successive speech units.

16. The method of claim 1 wherein the objective measure comprises an indication of a category for tonal identity of the current speech unit.

17. The method of claim 1 wherein the objective measure comprises an indication of a coupling degree of pitch, duration and/or energy with a neighboring unit.

18. The method of claim 1 wherein the objective measure comprises an indication of level of stress of a speech unit.

19. The method of claim 1 wherein the objective measure score for each synthesized utterance is a function of a length of said each synthesized utterance.

20. The method of claim 19 wherein the length comprises a number of speech units in an utterance.

21. A method for optimizing an objective measure, from which naturalness of synthesized speech can be estimated, wherein naturalness is a subjective quality of synthesized speech, the method comprising:

generating a set of synthesized utterances;

subjectively rating each of the synthesized utterances;

calculating a score for each of the synthesized utterances using an objective measure, the objective measure being a function of textual information derived from speech units used in the utterances and the objective measure comprising components being based on single-order textual features or a combination of at least two single-order textual features, the components having categorical values, wherein a distance between categories are empirically defined as values in distance tables, the components each further having a weighting value;

ascertaining a relationship between the scores of the objective measure and subjective ratings of the synthesized utterances; and altering the objective measure in a manner beyond only changing one or more weighting factors in the objective measure to provide a different function of textual information derived from the utterances so as to improve the relationship between the scores of the objective measure and subjective ratings of the synthesized utterances, wherein altering comprises altering the values in the distance tables followed by altering the weighting values.

22. The method of claim 21 and further comprising removing components of the objective measure as a function of the weighting values, and adjusting the weighting values of remaining components.

23. The method of claim 22 wherein altering the objective measure comprises selecting components of the objective measure as a function of the weighting factor of each component.

24. The method of claim 21 wherein altering the objective measure comprises selecting components of the objective measure as a function of its respective correlation to the subjective ratings of the synthesized utterances.

25. The method of claim 21 wherein the objective measure comprises at least one component being a combination of at least two factors from a set including:

an indication of a position of a speech unit in a phrase;

an indication of a position of a speech unit in a word;

an indication of a category for a phoneme preceding a speech unit;

an indication of a category for a phoneme following a speech unit;

an indication of a category for tonal identity of the current speech unit;

an indication of a category for tonal identity of a preceding speech unit;

an indication of a category for tonal identity of a following speech unit; and an indication of a level of stress of a speech unit;

an indication of a coupling degree of pitch, duration and/or energy with a neighboring unit; and an indication of a degree of spectral mismatch with a neighboring speech unit.

* * * * *